United States Patent [19]

Hoffmann

[11] 4,188,804

[45] Feb. 19, 1980

[54] DIAL AND CYLINDER KNITTING MACHINE

[76] Inventor: Nicole Hoffmann, 58 rue de Bellechasse, Paris, France

[21] Appl. No.: 914,017

[22] Filed: Jun. 9, 1978

[30] Foreign Application Priority Data

Jun. 16, 1977 [IT] Italy ..... 49856 A/77

[51] Int. Cl.[2] ..... D04B 9/20; D04B 9/22

[52] U.S. Cl. ..... 66/24; 66/51

[58] Field of Search ..... 66/24, 29, 47, 48, 51, 66/52, 53

[56] References Cited

U.S. PATENT DOCUMENTS

| | | | |
|---|---|---|---|
| 2,290,147 | 7/1942 | Booton | 66/51 |
| 2,400,805 | 5/1946 | Booton et al. | 66/48 |
| 2,939,302 | 6/1960 | Letzerich | 66/52 X |
| 3,650,126 | 3/1972 | Luchi | 66/48 |

FOREIGN PATENT DOCUMENTS

| | | | |
|---|---|---|---|
| 671957 | 10/1963 | Canada | 66/51 |
| 510356 | 7/1939 | United Kingdom | 66/24 |

*Primary Examiner*—Wm. Carter Reynolds
*Attorney, Agent, or Firm*—J. Harold Nissen

[57] ABSTRACT

A circular dial and cylinder knitting machine equipped for the forming of pouches with reciprocating motion with inclusion and exclusion pickers. The machine includes in combination: descent cams for needle butts and descent cams for selection jacks at each feed; cams for the raising of the selection jacks (and thus of the needles) for each feed. The raising cams are at different levels to act on butts at these different levels in the selection jacks and remain fixed during the forming of the pouches. The selection jacks include, for the forming of the pouches with a reciprocating motion and with several feeds, butts at a first level coincident with the entire arc of needles arranged for the forming of the pouch and butts at additional levels on smaller arcs offset from one another. The exclusion and inclusion pickers act on the first level of the jacks butts. The dial and cylinder needles can cooperate to form rib fabric with loop transfer. The loop transfer location can be proximate an active yarn feed.

10 Claims, 11 Drawing Figures

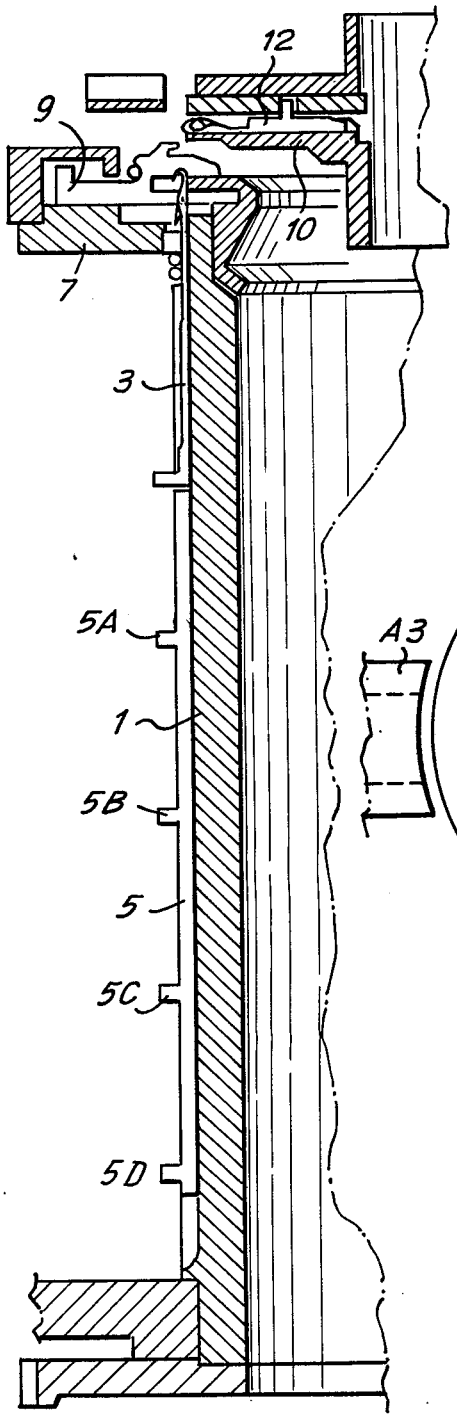
Fig. 2
Fig. 11
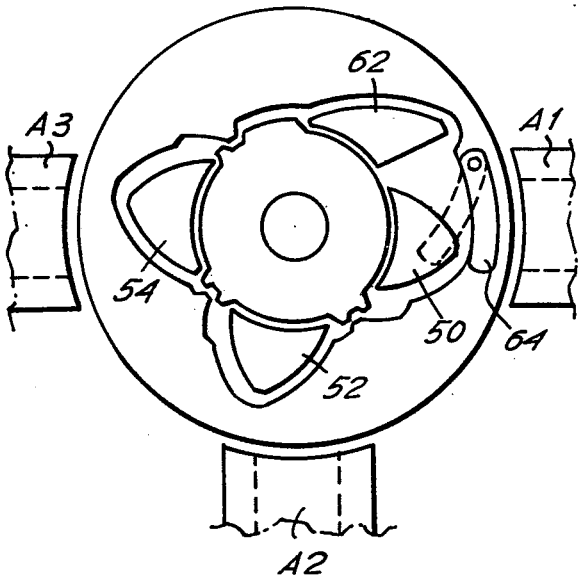

DIAL AND CYLINDER KNITTING MACHINE

The object of the present invention is an independent needle circular hosiery machine, in particular a machine having a cylinder diameter suited for the manufacture of stockings and socks; the machine is designed for the production of stockings of the conventional type with a knitted shaped heel. The machine may practically produce articles having: a portion forming the top knitted in plain stitch or rib structure with or without the elastic; a portion forming the leg, also in plain or rib stitch; the heel in a plain stitch knitting made up with a reciprocating motion, forming a pouch; and the foot in plain stitch or partly in rib fabric with the toe which may be made like the heel as a pouch or of the tubular type. The different parts of the stocking, as abovementioned, are manufactured with several knitting feeds including the alternate motion portions forming the heel and toe. The top, the leg and the foot of the stocking are produced in a conventional manner as on the stocking machines of the known type having multi-knitting feeds, both made in plain stitch and/or rib fabric.

A particular development of the present invention is the arrangement of the machine for the manufacture of the heel and/or the toe pouches using reciprocating motion, and keeping in operation all the knitting feeds or a part of the feeds used in the circular motion, however more than one.

The manufacture of the heel and toe pouches using reciprocating motion and multi-feed system is already known, also in the case of stocking heels. In the conventional type of the alternate multi-feed knitting, the case is reduced almost always to two feeds and they are used both from one end to the other of the width of the heel to be formed. Said system is bound to different textile difficulties to be overcome besides machine limitations, already per se known in the art. For instance, the inconvenience of having—upon the motion reversal—both yarn ends attached to the same vertical wale of stitches, is known, and this may determine damages of at least one of the yarns by the sinkers. Still, as all the operating needles must pass in two or more feeds the oscillation of the cylinder occupies a remarkable angular space, in its alternate motion with respect to the single feed method, and this is detrimental for the number of oscillations obtainable in the time unit.

The present invention allows to obviate the aforesaid drawbacks, besides giving the possibility of an easy knitting with the alternate motion also with more than two feeds, to form the knitted structures of particularly satisfactory pouches. For the above purposes, a circular knitting machine for stockings and other knitted articles has been improved, said machine being equipped for the forming of pouches with the reciprocating motion, including a cylinder with needle and selector jack grooves, a cam shell for the needles and selectors raising and lowering control in the two directions of the motion, and inclusion and exclusion "pickers". According to the invention, the machine includes in combination: lowering cams for the needle butts and lowering cams for the selectors, in correspondence of each of the feeds; selector (and thus needle) raising cams means for each feed, which cam means are fixed during the forming of the pouches and which cam means are at different levels to act on a same number of butts at different levels in the selectors; selectors including, for the forming of the pouches with a reciprocating motion and several feeds, at a first level, butts present on the entire arc of needles involved in the pouch knitting to allow the lowering of the selectors and at the additional levels, butts on smaller arcs, offset from one another and in the whole included in said arc; and means to exclude by means of lowering, the needles of the instep which do not work during the forming of the pouch; exclusion and inclusion pickers are arranged to act on the butts of the jacks at the aforesaid first level of the jacks butts.

According to an embodiment said raising cam means of the selectors are fixed, the selector butts in the arc corresponding to the heel and toe pouches have a uniform length on each level and the butts on said other levels are developed in smaller arcs and offset from one another but included in the arc of the butts of the first level.

According to an embodiment, the selector butts on said first level in the arc corresponding to the heel and toe pouches have two lengths, to allow the pickers to lower the selectors on the arc of needles arranged for the forming of the pouch and the butts on said other levels are developed in smaller arcs and offset both from one another and with respect to the arc of the high butts of said arc of butts on said first level.

The raising cam means of the selectors in this case too are fixed, and the butts on said additional levels have a uniform length.

Alternatively, said raising cam means of the selectors are equipped to be radially moved in two positions before the start of the pouches, and on all the levels the pouch butts have two lengths to obtain two types of operation.

The machine may include cams that can be inserted to put the selectors in and out of operation at the start and end of the pouch forming, said cams being designed to act on the butts of said first level, where the butts in the arc corresponding to the instep are longer than those in the arc of the heel and toe pouches, so that they may be separately taken to an idle level during the reciprocatory knitting.

The machine is also advantageously combined with means to form rib knits with radial needles on the dial, without excluding any yarn feed.

It is a further purpose of the invention to equip the machine with a device capable of allowing the rib knitting avoiding losses of angular space for the means designed for the transfer of the stitches from the dial needles to the cylinder needles, allowing a remarkable number of feeds, and allowing the feeds to remain always in operation also during the transfer.

To this purpose the machine is provided with a device capable of effecting the transfer of the knitting loops from the radial needles of a dial to the cylinder needles in the circular hosiery machines and especially for socks, designed to set up ribs knittings with several feeds. According to the invention, in correspondence of one of the yarn feeds and of the respective raising cams and lowering cams of the cylinder and of the dial needles, there are provided an auxiliary push out cam of the dial needles and an auxiliary control cam of the re-entry of said needles of the dial, which auxiliary cams are inserted for the transfer and act in advance with respect to the corresponding actuation of the cylinder needles, the first with a major push out-action with respect to the one determined by the other cams of the dial to allow the engagement of the rib loops by the cylinder raising needles, and the second to obtain a re-entry of the dial needles before they can take the yarn of the considered feed, which feed remains in operation also during the transfer action feeding only the cylinder needles.

The usual push out cam of the dial needles is made retractable, to allow the activation of the re-entry auxiliary cam of said needles.

Said re-entry auxiliary cam of the needles or the dial may be developed like an angularly movable cam, which at rest is located out of the normal re-entry path of the dial needles and within the profile designed to operate the usual re-entry of the dial needles.

The invention will be now explained making reference to the accompanying drawing, which illustrates an embodiment not restricting the same invention, for a three-feed machine; the number of feeds could also be smaller or greater than in the embodiment here mentioned, appropriately varying the design of the cams and the arrangement of the jacks, but always remaining in the same principle.

In the drawing:

FIG. 2 illustrates a semi-section of the cylinder and dial;

Figure 1:
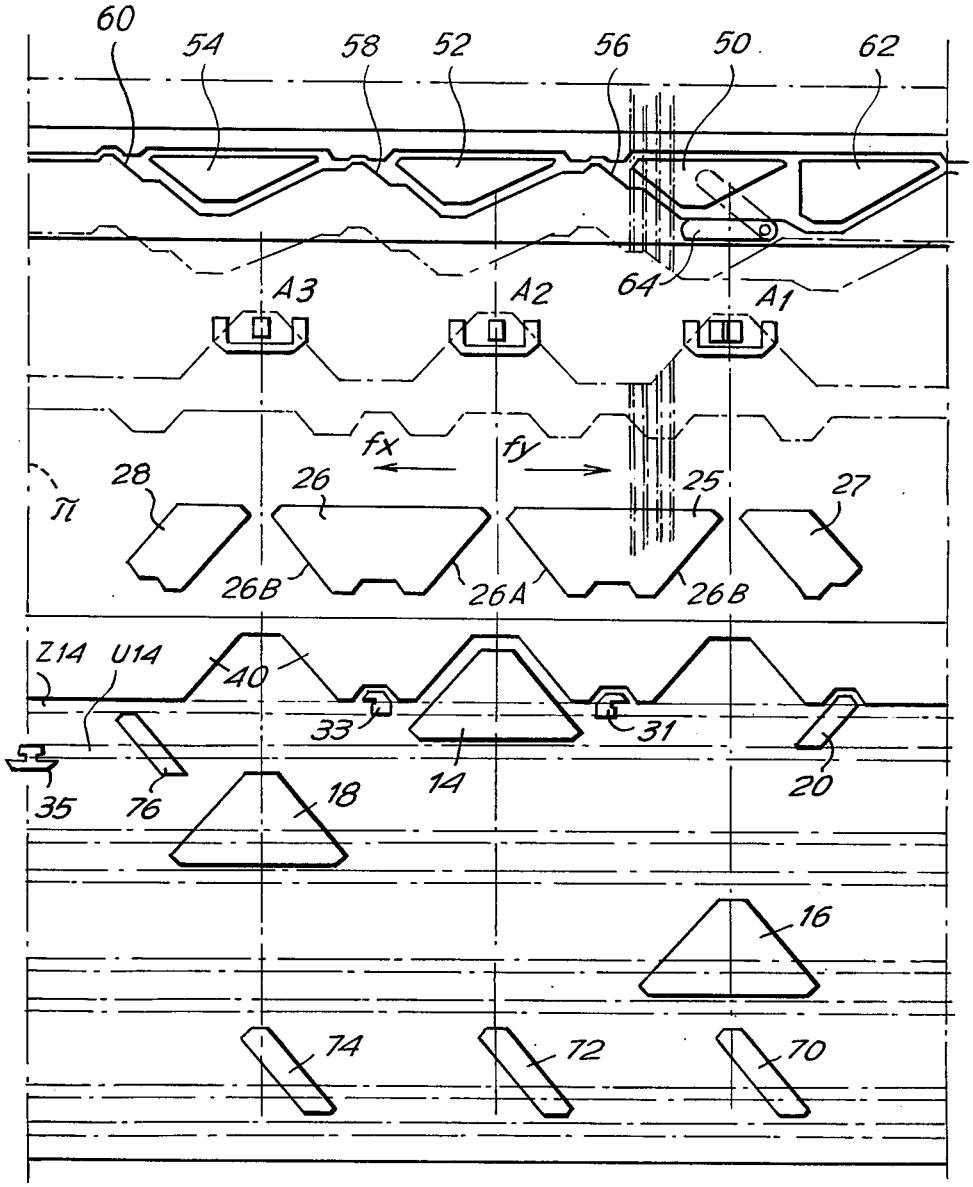
FIG. 1 illustrates the development of the cams of the cylinder and of the cams of the dial.

FIG. 11 illustrates a view of the radial dial needles and control cams. In FIGS. 1 to 5 of the drawing, there is shown a machine involving an usual needle-carrier cylinder 1 in whose longitudinal grooves are located the needles 3 and the selection jacks 5 having several orders of butts, the butts of each order cooperating with each of several cams. A sinker-carrier plate 7 of a known type forms the radial seats for the sinkers 9. Centrally, according to the drawing, there is provided a dial 10 with radial seats for needles 12 of a second bed.

The drawing illustrates a characteristic arrangement of the jacks butts and of the cylinder cams, which are operating on said butts of the jacks.

The pouches of the heel or of the stocking toe are usually formed starting from substantially the half of the needles present in the cylinder and operating with a progressive decrease and consequent following increase of needles at the two ends of those operating, in such a manner to form the desired pouch, working with a reciprocating motion of the needle cylinder. In the described example, in which the invention is set up, one likewise starts from a number of needles corresponding to about the half of those existing on the cylinder and one then proceeds to exclusions and re-insertions. The needles which are excluded upon the start of the alternate motion are merely left downwards in an idle level and are no longer raised in the three feeds $A_1$, $A_2$, $A_3$. This is a difference from almost all the stocking machines, where the exclusion of the needles for pouch formation takes place by raising them above the knitting cams. The excluded needles then continually pass under the knitting cams, during the alternate motion. Also the needles progressively excluded at the ends of the working arc, are left downwards at the level of the previously excluded ones.

In correspondence of the three illustrated feeds the needles are raised with the purpose of taking the yarn from the respective throat plates, by means of three cams 14, 16, 18. The cam 16 raises the needles at the feed $A_1$, the cam 14 raises the needles at the feed $A_2$ and the cam 18 raises them at the feed $A_3$ (especially see FIG. 1). The cam 14 acts on the butts 5A formed on the jacks 5, the cam 18 acts on the butts 5B and the cam 16 acts on the butts 5C.

Figure 3:
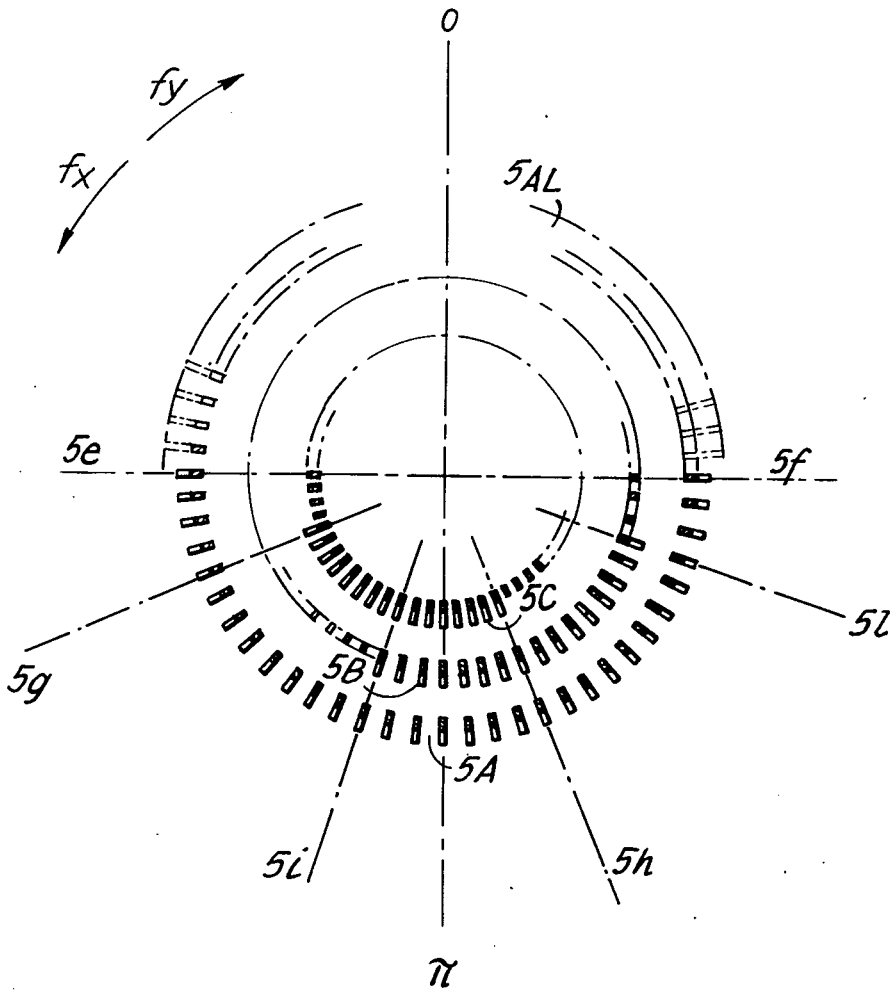
FIGS. 3 and 4 illustrate in a perspective axial view a scheme of the butts of the jacks and the cams operating thereon.

FIG. 3 illustrates a plan view of the arrangement of the butts which occur on the jacks in the different orders 5A-5B-5C. The butts 5A are present along the entire circumference of the cylinder. For a half of the cylinder, they are provided like long butts 5AL, while in the other half they are short butts 5A; these butts 5AL are illustrated only in FIG. 3 and not in the other figures, for drawing clarity. The butts 5B are present only on a portion of the cylinder contained within the arc of the short butts 5A, said portion being located in an asymmetrical manner with respect to the centerline of the latter, that is with respect to the axis 0–$\pi$. The butts 5C, like those 5B, are present only on a portion of the cylinder contained within the arc of the short butts 5A, still located in an asymmetrical manner with respect to the centerline, that is to the axis 0–$\pi$, but in an opposite direction with respect to the butts 5B. A portion of the butts 5C is superimposed to the butts 5B, whereby in a central zone one will have the presence of the butts 5A-5B-5C on the jacks 5. In the two zones respectively lateral with respect to the previous one, there will be on one side the butts 5A-5B and on the other side the butts 5A-5C. The decreases of needles and the increases of the needles will be effected by the respective pickers acting only in the lateral zones where only the butts 5A are present.

Figure 4:
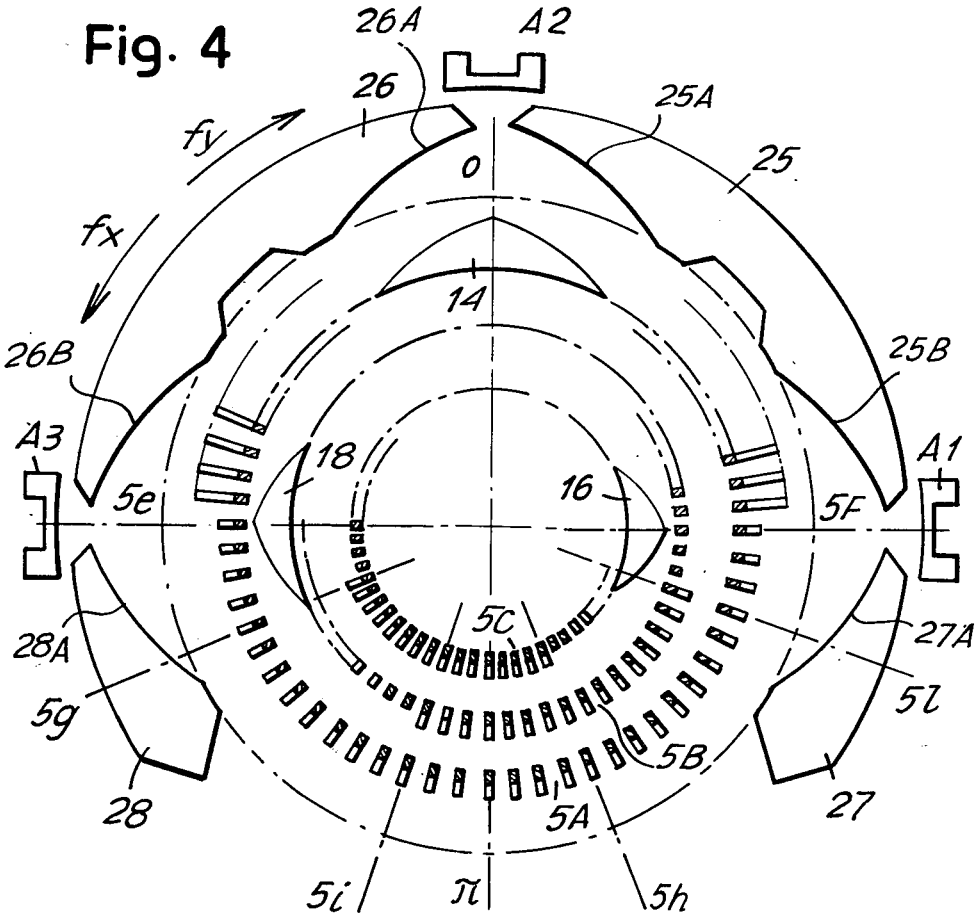

In the entry stage in the alternate motion, the cylinder rotates according to the direction fX indicated in FIGS. 1, 3 and 4. During the last revolution in this direction, before entering the reciprocating motion, a movable cam 20 partly enters, acting on the long butts 5AL, lowering them from the working channel Z14 to the inactive channel U14. When the cylinder arrives at the dead point, the butts of the jacks are located in relation to a radial zero reference origin, denoted by 0 in FIG. 4, in the position indicated in the plan view of the machine as illustrated in said FIG. 4. From this position, the cylinder is ready to reverse the rotational direction, starting according to the direction fY. The end **5*e* of the row of butts 5A has completed the passage under the knitting cam 26, having formed a stitch course with the front 26A at the feed A2 and then is ready, re-climbing up the raising cam 14, which is symmetrical, to begin a partial course in the same feed $A_2$ knitting with the cam 25 on the front 25A. At the end of the oscillation—which will be approx. 360°—also the end** 5*f* of the row 5A will be passed under the cam 25. The cam 27 cooperates with the cam 25 to form the knitting in the feed $A_1$ with the fronts 27A and 25B. The cam 28 cooperates with the cam 26 for the forming of the knitting in $A_3$ with the fronts 28A and 26B.

Still at the start of the oscillation in the direction fY one sees that for the same reasons before mentioned for the butts 5A, also the butts 5B are in conditions to climb on the cam 18. It will thus occur that all the needles knitting the heel will take the yarn at the feed $A_2$, because cooperating with jacks having the butt 5A. The needles corresponding to the butts 5B will pass also into the feed $A_3$ whereby in the arc included between the ends 5*i* and 5*l* another course of loops will be formed. From FIG. 4 one also sees that during the oscillation in the direction fY the butts 5C may climb onto the raising cam 16, thus causing the corresponding needles to climb at the feed $A_1$, also producing a course of loops themselves in the arc included between 5*g* and 5*h*.

At the end of the oscillation according to fY, thus a course will be produced in the arcs (e-g) and (l-f), two courses in the arcs (g-i) and (h-l) and three courses in the arc (i-h). Then there is a new oscillation in the direction fX and so on, with similar knitting of courses.

During the occurring of the oscillations, the pickers 31 and 33 lower a jack per part, locating it from the channel Z14 into the channel U14, thus excluding a needle per part from the work; the pickers act on the butts of the ends of the arc of the butts 5A which are in operation. The decreases are all contained in the arcs 5*e* - 5*g* and 5*l* - 5*f*.

During the subsequent stage of the increases, there will be a picker 35 taking one or two needles per part—at each oscillation—from the channel U14 to the channel Z14, while the exclusion pickers 31 and 33 continue to operate if two needles are each time inserted by the picker 35, or said pickers 31 and 33 will be stopped and neutralized, if the picker 35 moves only one needle.

As the extension of the pouch thus produced to form for instance the stocking heel is proportional to the number of the produced courses, and as also in the pouches for the conventional heels the shaping is such whereby in the centre one has more courses than at the sides, in the present case, having produced in the centre in the arc i-h three courses for each oscillation, one needs a total number of oscillations equal to a third of those required in a conventional machine with a single feed knitted heel. As it is seen in FIG. 4, the possibility of having a graduality of number of courses in the different parts of the arc of the heel is bound to the plan arrangement of the butts 5A, 5B, 5C.

Figure 5:
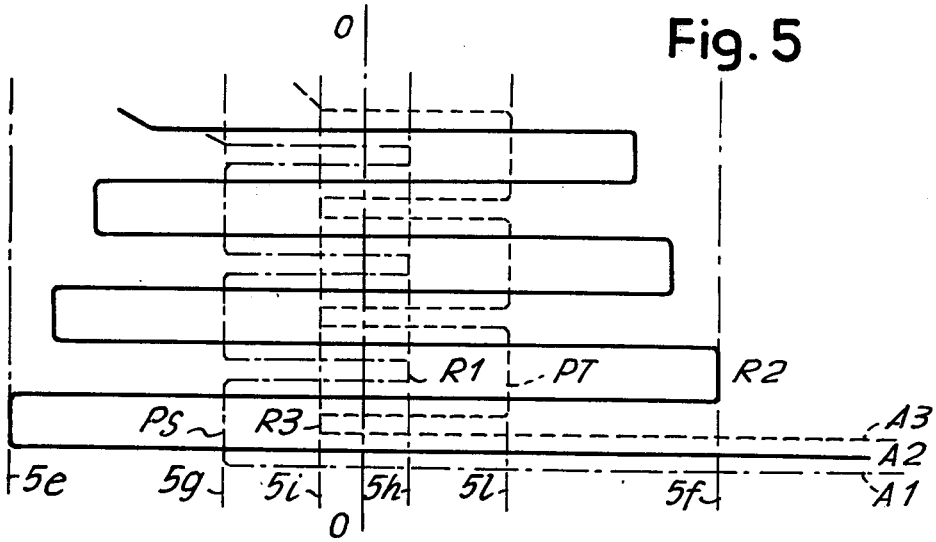
FIGS. 5 and 6 illustrate the scheme and development of the structure of the fabric of a pouch.
Figure 6:
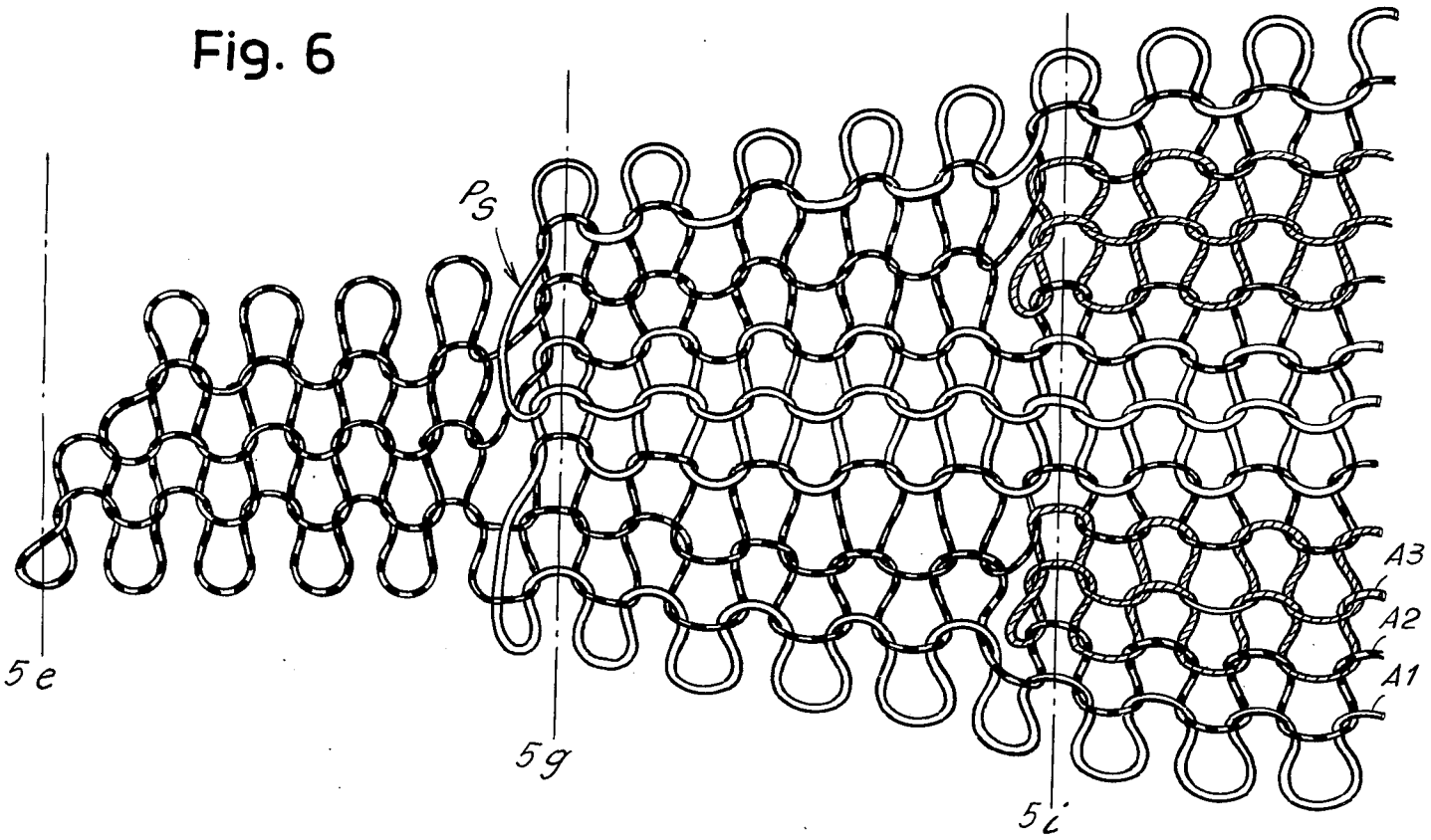

FIG. 5 illustrates a sketch and FIG. 6 an enlargement of the knitting structure in the zone of the heel, defining with 5*e*-5*g*-5*i*-5*h*-5*l*-5*f* the different angular positions already defined in FIG. 4 as ends of arcs of butts. In FIG. 5 there is shown the trend of the courses of loops produced by the several feeds $A_1$, $A_2$, $A_3$. With a solid line, there is marked the path of the courses produced in the feed $A_2$, which cover the entire zone of the butts 5A and are gradually reduced in length at the ends 5*e* and 5*f*, by effect of the decrease produced by the pickers. The dot and dash line marks the path of the courses produced in the feed $A_1$, by the jacks having the butts 5C, which—as it is seen—oscillates between the lines 5*g* and 5*h*. Upon the first reversal, the course of the feed $A_1$ does not return getting cast off on itself, but must jump two courses made in the feed $A_2$ producing a bridge of yarn indicated by $P_S$ in FIGS. 5 and 6. The dash line represents the path of the courses produced in the feed $A_3$ by the jacks having the butts 5B which oscillates between the lines 5*i* and 5*l*. Upon the first reversal the course formed by the feed $A_3$ returns into $R_3$ being cast off on itself. Upon the second reversal the course of the feed $A_2$ returns into $R_2$ being cast off on itself, while this time it will be the course of the feed $A_1$ which returns on itself in $R_1$ and will be the course of the feed $A_3$ to create a bridge $P_T$, which will jump over two courses made in the feed $A_2$.

It is important that in the central part of the pouch, defined by 5*i*-5*h*, there are no bridges; in fact one needs in this zone to reach the maximum possibility of extension. In the lateral zones, the bridges in 5*g*-5*l* do not disturb and help to reduce the longitudinal dimensions, emphasizing the effect of the pouch.

The present machine is also suitable for the knitting of pouches for heel and toe, with a structure different than the one hitherto described.

Figure 7:
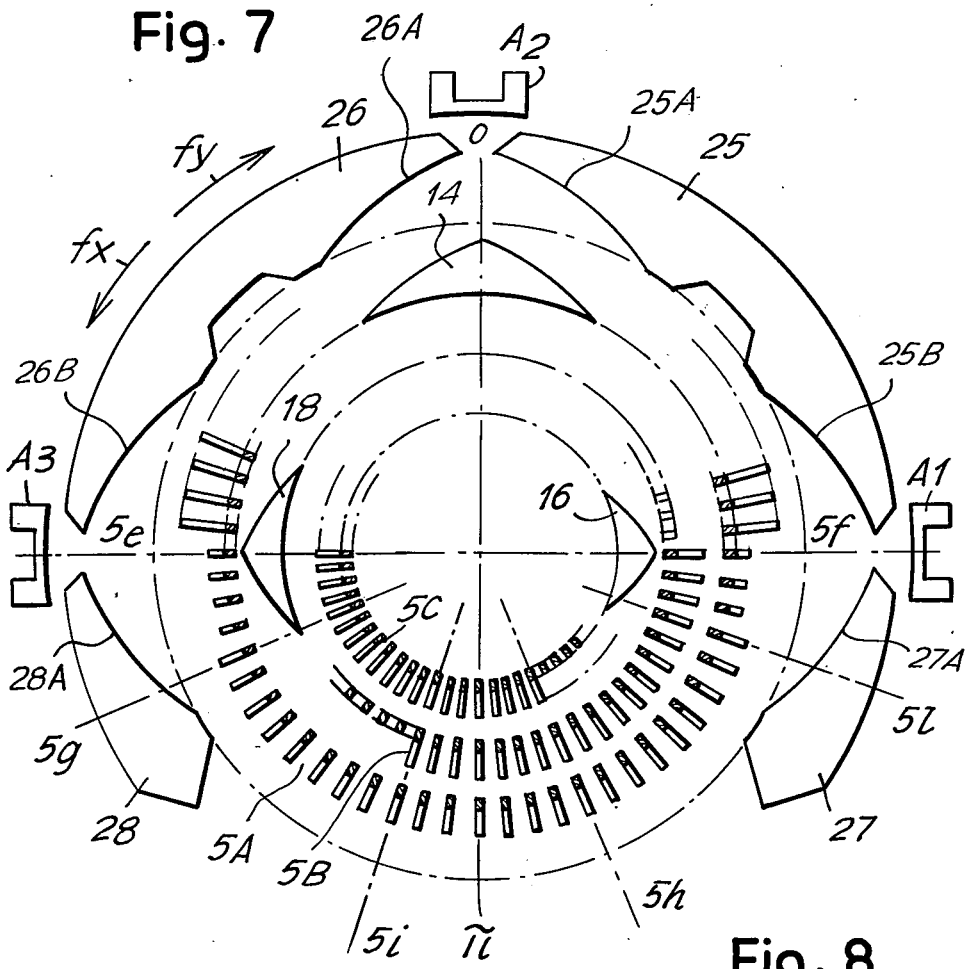
FIGS. 7, 8 and 9 illustrate a variation in a manner similar to FIGS. 4, 5 and 6.
Figure 8:
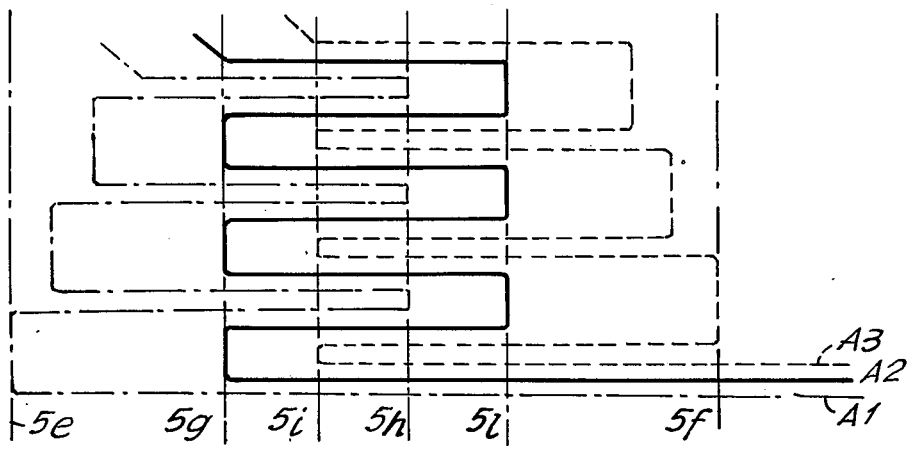
Figure 9:
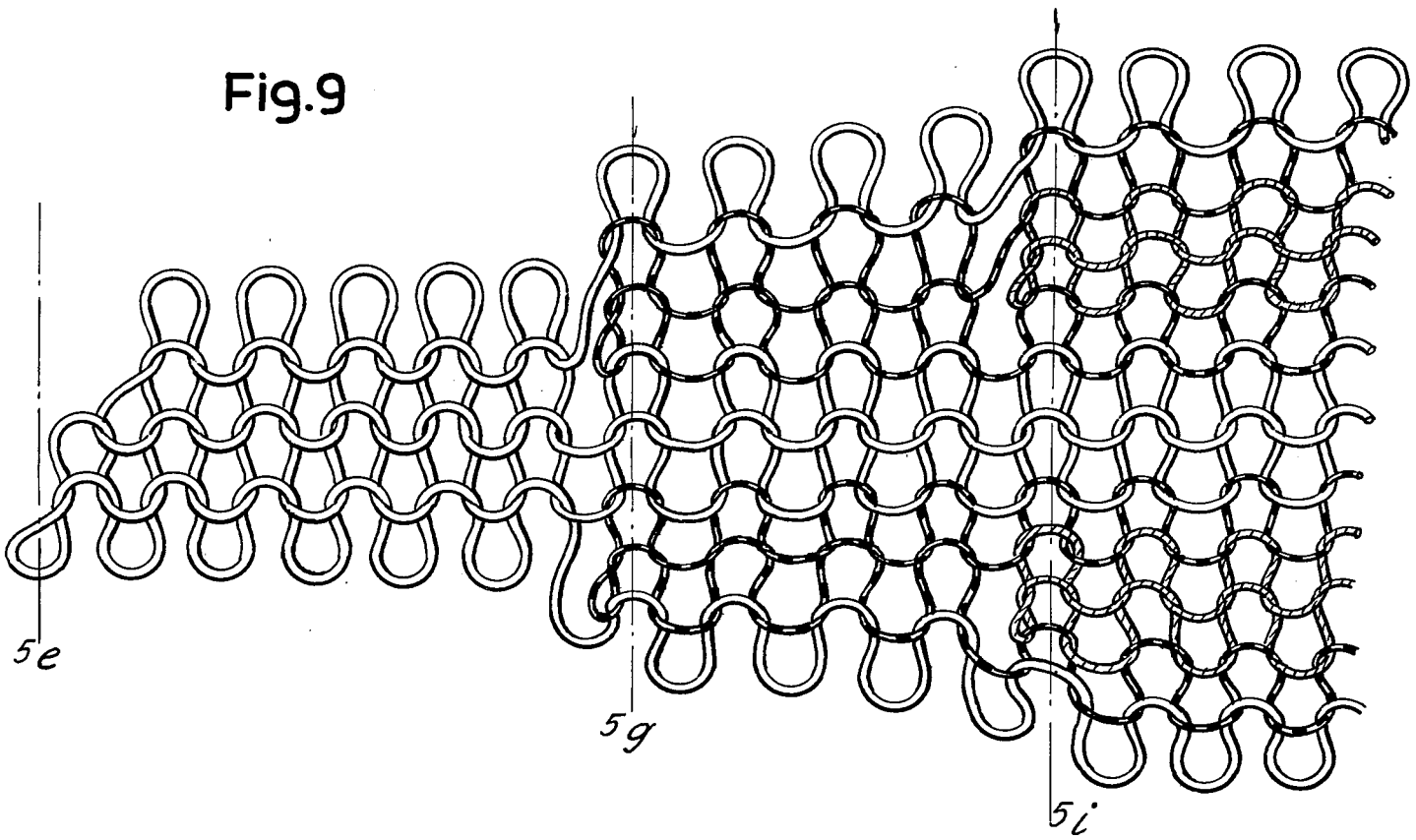

With a different arrangement in plan of the three orders of butts 5A, 5B, 5C (see FIG. 7) it is in fact possible—still with the same machine and with the same cams—to produce a heel without any bridges, that is with an arrangement of the courses of loops such as that of FIGS. 8 and 9, in which one sees that upon the reversal each course returns to be cast off on itself by both ends.

In order to set up the arrangement of FIGS. 8 and 9, the arc of butts 5A is made with two lengths, that is the arc between the positions 5*g* and 5*l* with butts having a major length, and the arcs between the positions 5*e*, 5*g* and 5*l*, 5*f* with short butts (see FIG. 7). The lengths of the butts 5A included between the lines 5*e*, 5*g* and 5*l*, 5*f* will have a reduced length in such a manner as to operate only with the lowering cam 40 in correspondence of the three feeds, together with the remaining of the needles of the same order 5A, but not to operate with the cam 14.

The knitting procedure in this case will be similar to the former, but with a different sequence of passages of the different butts 5A-5B-5C on the cams 14, 16, 18. A picker receives the first butt and lowers or raise it; the picker being moved by the butt. The cam 14 will be located remote from the cylinder by an amount sufficient not to interfere with the short butts 5A before mentioned, i.e. those that are included between the lines 5*l*-5*f* and 5*e*-5*g* but sufficiently close to the cylinder to raise the butts 5A included between the lines 5*g* and 5*l*. The cam is moved when the reciprocating motion begins. Cam 14, as depicted in FIG. 7, is inserted as the butts 5A over the arc 5*f*-5*l* pass radially inwardly thereof such that the butts that follow, extending over arc 5*l*-5*g* are raised thereby. In this position of insertion cam 14 will not engage and raise the butts over arc 5*g*-5*e* in addition to those of arc 5*f*-5*l*. Therefore the butts 5A will climb on the cam 14 in the portion included between the lines 5*g* and 5*l*, feeding the corresponding needles in the feed A2. The butts 5B will climb on the cam 18 feeding the needles in the feed A3 and the butts 5C will climb on the cam 16 feeding the needles in the feed A1. Also in this case, in a manner analogous to that set forth with respect to FIGS. 1 to 6, for each oscillation there will be knitted three courses in the portion included between the lines 5*i* and 5*h*, two courses in the portions between the lines 5*g*, 5*i* and 5*h*, 5*l*, and a course in the portions between the lines 5*e*, 5*g* and 5*l*, 5*f*, the pickers lower the appropriate jack parts to obtain the appropriate sequence for the knitting procedure.

The type of heel thus obtained is the one disclosed in the U.S. Pat. No. 3,650,126. The here described machine allows to obtain it with a particular simplicity and advantages with respect to the machine described in the aforesaid patent. In fact in the machine—object of the present invention—there are no cams moved by a reciprocating motion at each oscillation of the cylinder and in sequence therewith.

The needle used is of the usual type and not of the special type hooked to the selector as in the aforesaid U.S. Patent. In fact there is a practical inconvenience in the use of said hooked needles as for their replacement, it is necessary to remove or at least to detach the selector from the cylinder groove.

Moreover, in the machine of the aforesaid Patent. The needles are excluded from knitting by being raised upon the stitch formation cams, whereby the yarns of the different feeds, after having terminated their knitting courses on the needles according to the selection thereon produced by the selectors, as they pass in front of the other feeds are taken between the sinker nibs and stems of the excluded needles in some cases for very wide arcs and thus damaged. The take-up of said yarns becomes particularly difficult by the yarn absorber devices.

In the cylinder cams layout described and illustrated in figure in the U.S. Patent, owing to the type of manufacture, the exclusion pickers are located at the sides of the group of cams operating during the alternate motion. Considering the example of the 3-feeds machine, in practice it is impossible to locate said cams and said exclusion pickers in an arc smaller than 180° as indicated in the Patent; the rotation of the cylinder which is consequential, for a heel which usually concerns 180°, is remarkably major than 360° so reducing the productivity.

Figure 10:
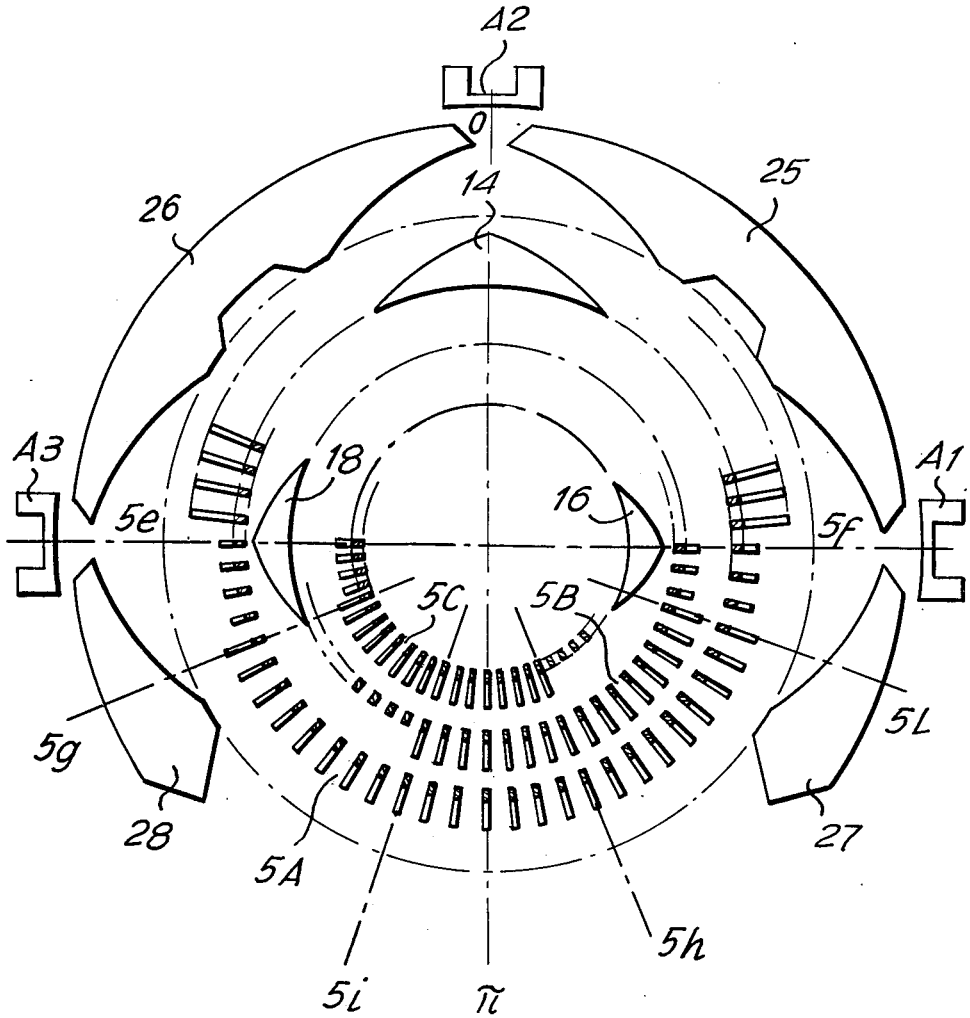
FIG. 10 illustrates a variation of FIG. 7.

According to the variation of FIG. 10, one may obtain the two above described solutions without modifying the arrangement of the jacks, but only radially moving the cams 14, 16, 18 in two positions. The rows of butts 5A, 5B, 5C in this case have long and short butts as indicated in FIG. 10; inserting totally the cam 14 and partly the cams 16 and 18, one obtains the pouch according to the first example (FIG. 5); on the contrary inserting totally the cams 16 and 18 and partly the cam 14, one obtains the pouch according to the second example (FIG. 8).

The present machine may operate with three or also more feeds from the start of the stocking through all its portions to the end, where the stocking top, the leg and the instep may be knitted in rib fabric, by use of the needles 12 (see FIG. 2) located on a dial 10. In FIG. 11 the control cams of said needles 12 are visible.

For the knitting of the rib fabric, with the purpose of obtaining the maximum use of the angular space both on the cylinder 1 and on the dial 10 for the location of the higher number of yarn feeds, a peculiar set up of the transfer means of the loops from the needles 12 of the dial to those 3 of the cylinder is provided.

More particularly, the production of the rib fabric by the means described in this machine, that is with two sets of needles 3 and 12, one in the cylinder and the other in the dial, involves that in a stage of the knitting of the stocking (or in more stages), one must effect a transfer of loops. Said transfer requires a radial exit of needles in the dial and a raising of the needles in the cylinder; in the particular case, the transfer of loops takes place from the needles of the dial to those of the cylinder. The space used for said movement of needles is usually employed—in the hitherto known arrangements—only for the transfer function, an operation which takes place only once or twice in the make of the stocking and does not form a part of the fabric active production. The angular space for the transfer is thus substracted to the useful space for the location of yarn feeds.

In the present embodiment, it is instead possible to use the space employed for the transfer also as a yarn feed, that remains active also in the transfer stages.

The transfer-yarn feed combination is here located in correspondence of the feed $A_1$. The synchronization of the needle movements between the cylinder 1 and the dial 10 for the rib knitting, is effected according to a conventional scheme, as it is visible from the rectilinear lay-out of the cams and profiles of the dial 10, shown in the top section of FIG. 1 in a relative position with respect to the cams which act on the jacks 5 and on the cylinder needles 3. The start of the exit of the needles 12 of the dial 10 in front of the different feeds, obtained by cams 50, 52, 54—cooperating with fixed profiles 56, 58, 60—takes place in delay with respect to the raising of the cylinder needles 3, obtained by the cams 70, 72 and 74. This is particularly useful, so that the needles 3 of the cylinder act as a comb for the needles 12 of the dial 10, cooperating with the sinkers 9 to prevent the rib stitches—formed by the needles of the dial 12—to be urged outwardly by the clearing action of the rib needles.

The transfer of loops from the needles 12 of the dial 10 to those 3 of the cylinder 1 requests—always according to a known method—that the needles 12 of the dial come out in advance (instead of in delay) with respect to the raising of the cylinder needles 3.

In order to effect this anticipated exit, one uses the space corresponding to the feed $A_1$. The dial is provided with an insertable and disengageable cam 62 and an angularly movable cam 64 for the re-entry of the needles 12; said cam 64 in order to be active is moved in the working zone of the cam 50, which is thus retractable. The cam 62, besides the aforesaid advance, also provides to outwardly urge the needles 12 by an amount superior to that obtained by the cams 50, 52, 54: this is required for the transfer. The cam 62 and thus the cam 64 are introduced of course only upon the instant of the transfer and only for the duration thereof. It thus occurs that the cylinder needles 3 get into the loops of the dial needles 12, being raised after the radial centrifugal movement of the needles 12. In their re-entry movement, obtained with the cam 64, the dial needles 12 yield the loops to those 3 of the cylinder, which are kept raised, as their loops, being passed beyond the latches, may be released. In order that the transfer operation occurs, it is however necessary that the dial needles 12 which have yielded the loops are substracted from taking the yarn at the feed A1. For this, the rotary cam 64 is located in the position indicated by dotted line, after having withdrawn the cam 50 and said cam 64 is arranged in such a manner to withdraw in advance the dial needles 12, before they may take the yarn of feed $A_1$, which is however continuously feeding the needles 3 of the cylinder, which are lowered by the cam 25, while the jacks are lowered by the profile 40.

The other elements of the machine, visible in the lay-out of FIG. 1 and not hitherto mentioned, are usual cams which serve for the usual operations relating to the remainder of the stocking cycle. Thus for instance, the cams 70, 72, 74 serve for the raising of the selectors through the butts 5D and thus of the needles in the feeds $A_1$, $A_2$, $A_3$, when the machine is in the circular motion. The cam 76 serves for the contrary action to that of cam 20, and that is to re-activate the needles 5AL excluded during the forming of the pouches of the heel and toe.

Many variations may be provided within the concepts of the annexed claims.

What I claim is:

1. Circular machine for stockings and other knitted articles, equipped for the formation of pouches with reciprocating motion, including cylinder needles, a cylinder with grooves for said cylinder needles and selection jacks, a cam shell for the control of raising and lowering of said needles and said selection jacks, said needles including butts, a plurality of yarn feeds, and inclusion and exclusion pickers, and further including in combination:

first descent cams for said needle butts and second descent cams for said selection jacks, in correspondence with each of said yarn feeds, cam means for raising said selection jacks together with said needles for each said yarn feeds, said cam means being at different levels to act on a same number of rows of butts at different levels in said selection jacks and remaining fixed during the forming of the pouches;

said needles being arranged along a needle arc for forming the pouch;

said selection jacks including, for the forming of the pouches with a reciprocating motion with several feeds, at a first level butts present on said entire cylinder needle arc arranged for the forming of the pouch and at additional levels butts on smaller arcs, offset from one another and in the whole included in said arc arranged for the forming of the pouch;

means to exclude by lowering the needles of the instep which do not work during the pouch forming; and, exclusion and inclusion pickers which act on the first level of said selection jack butts.

2. Machine as in claim 1, wherein said cam means (14, 16, 18) for raising of said selection jacks are fixed, said butts (5A in FIG. 3) in the pouch arc on said first level have a uniform length, and said butts (5B, 5C in FIG. 3) on said additional levels are developed on minor arcs and offset from one another but included in the arc of the butts of the first level (FIG. 3).

3. Machine as in claim 1, wherein said butts (5A in FIG. 7) in the pouch arc on said first level have two lengths to allow with all the butts the action of said pickers on the selection jacks in the cylinder needles arc arranged for the forming of the pouch, and said butts (5B, 5C in FIG. 7) on said additional levels are developed in minor arcs and offset both from one another and with respect to the arc of high butts of said arc of butts on said first level (FIGS. 7 and 10).

4. Machine as in claim 3, wherein cam means (14,) said butts on said additional levels have a uniform length (FIG. 7).

5. Machine as in claim 3, wherein said cam means (14, 16, 18) for the raising of the selection jacks can be radially moved into two positions before the start of the pouches, and on all the levels the butts for the pouch have two lengths, to obtain two types of operation (FIG. 10).

6. Machine as in claim 1, further including insertable cams (20, 76) to put in and take out of work the selection jacks at the start and end of the pouch forming, said cam means (20, 76) being designed to act on the butts of said first level (5A).

7. Machine as in claim 1, further including a dial and radial dial needles thereon for the forming of rib knits on all the feeds and in correspondence of one of said feed means designed to effect loop transfer without removing any feed from the operation, by means of an advanced movement of the radial needles and an advanced re-entry in respect of the normal knitting path.

8. Machine as in claim 7 and including, in correspondence of one of the yarn feeds, respective thrust (raising) cams and return (lowering) cams of the cylinder and the radial dial needles, and further including a first auxiliary control cam (62) for the thrust of the dial needles and a second auxiliary control cam (64) for the re-entry of said dial needles, said auxiliary cams being inserted for loop transfer in advance in respect of the corresponding actuation of the cylinder needles, said first auxiliary cam having a greater projection in respect of that determined by the other dial cams, to allow the seizing of the reverse loops by the cylinder raising needles, said second auxiliary cam (64) being shaped to obtain a re-entry of the radial dial needles before the seizing of the yarn at said feed, said feed so remaining active also during the transfer.

9. Machine as in claim 8, wherein said thrust cam (50) of the radial dial needles is retractable to allow the activation of the auxiliary re-entry cam of said needles.

10. Machine as in claim 8, wherein said second auxiliary cam (64) for the re-entry of the dial needles is an angularly movable cam, which at rest is located out of the normal re-entry path of the dial needles.

* * * * *

UNITED STATES PATENT AND TRADEMARK OFFICE

CERTIFICATE OF CORRECTION

PATENT NO. : 4,188,804

DATED : February 19, 1980

INVENTOR(S) : Nicole Hoffmann

It is certified that error appears in the above-identified patent and that said Letters Patent are hereby corrected as shown below:

Col. 6, Line 30 "raise" should be --raises--

Col. 10, Line 3 delete "cam means (14)"

Signed and Sealed this

*Fourteenth* Day of *October 1980*

[SEAL]

*Attest:*

SIDNEY A. DIAMOND

*Attesting Officer*

*Commissioner of Patents and Trademarks*